United States Patent [19]

Bitter, Jr. et al.

[11] 4,303,923

[45] Dec. 1, 1981

[54] PROBE LOOP FEED FOR TRANSVERSE EDGE WAVEGUIDE SLOT RADIATOR

[75] Inventors: Charles R. Bitter, Jr., Scottsdale; Terry D. Hafer, Tempe, both of Ariz.

[73] Assignee: Motorola Inc., Schaumburg, Ill.

[21] Appl. No.: 65,299

[22] Filed: Aug. 9, 1979

[51] Int. Cl.[3] ..... H01Q 13/10

[52] U.S. Cl. ..... 343/771

[58] Field of Search ..... 343/767-771, 343/708

[56] References Cited

U.S. PATENT DOCUMENTS

| | | | |
|---|---|---|---|
| 2,414,266 | 1/1947 | Lindenbald | 343/771 |
| 2,438,119 | 3/1948 | Fox | 343/771 |
| 2,574,433 | 11/1951 | Clapp | 343/771 |
| 2,597,144 | 5/1952 | Clapp | 343/771 |
| 2,661,422 | 12/1953 | Johnson et al. | 343/701 |
| 2,971,193 | 2/1961 | Siukola | 343/771 |
| 3,004,259 | 10/1961 | Shanks et al. | 343/721 |
| 3,176,300 | 3/1965 | Kuecken | 343/767 |
| 3,340,534 | 9/1967 | Fee | 343/768 |
| 3,987,458 | 10/1976 | Reggia | 343/708 |

*Primary Examiner*—Eli Lieberman

*Attorney, Agent, or Firm*—Eugene A. Parsons

[57] ABSTRACT

A transverse edge slot defined in the narrow wall of a rectangular waveguide with a first elongated conductor portion having one end attached to the narrow wall adjacent the slot and the second end extending inwardly generally perpendicular to the narrow wall and a second elongated conductor with one end connected to a broad wall and the free ends connected together to form a probe-loop feed.

6 Claims, 2 Drawing Figures

Fig 1
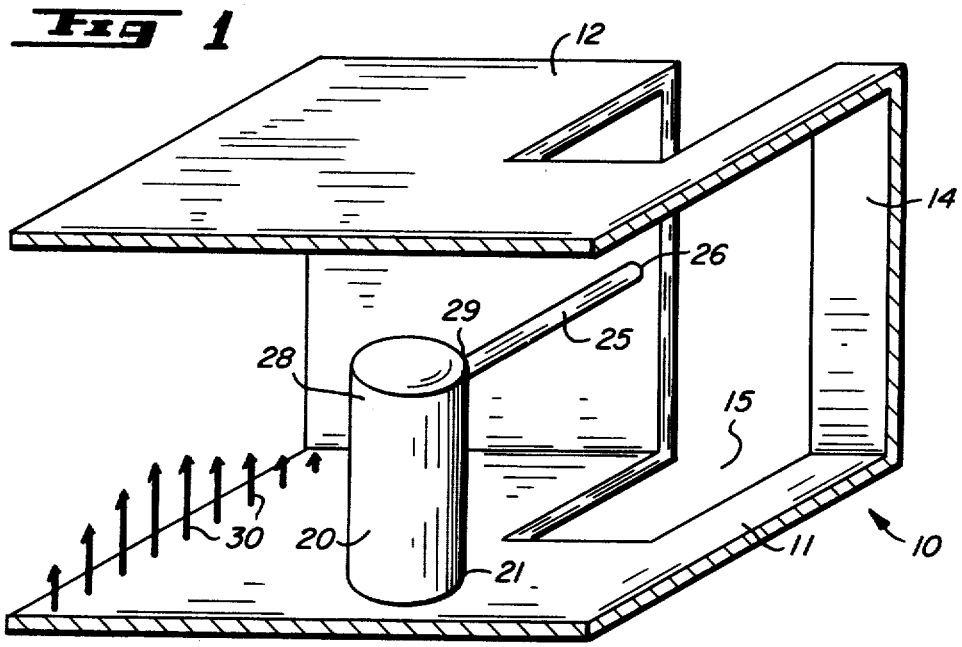
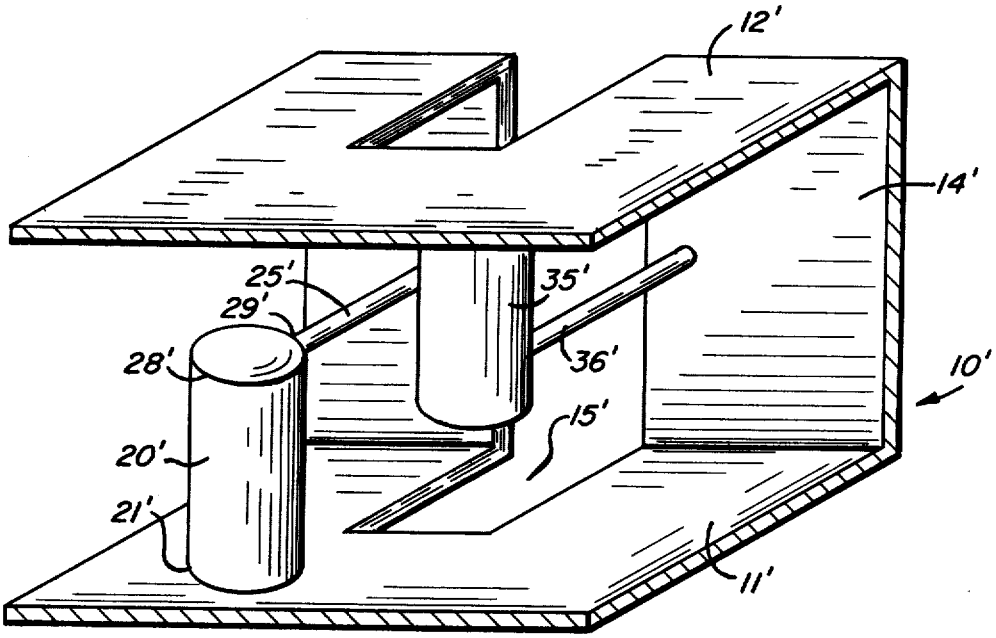
Fig 2

PROBE LOOP FEED FOR TRANSVERSE EDGE WAVEGUIDE SLOT RADIATOR

BACKGROUND OF THE INVENTION

Waveguide slot radiators, utilized as antennas and the like, are relatively well known in the art. Typically, the narrow wall true transverse waveguide slots have been little used as practical radiating elements. This is possibly because the excitation methods described in the literature are physically unwieldly in the smaller waveguide sizes such as C, X, and KU bands. In the dominate waveguide mode transverse narrow wall waveguide slots are located in a portion of the waveguide wall in the neighborhood of which there is substantially no component of the oscillating electric field perpendicular to the waveguide wall and the electric field approaches zero toward such wall of the waveguide. Therefore, no radiation takes place without inserting a suitable probe into the guide adjacent to the slot to introduce asymmetry in the field and current distributions for excitation of a field across the slot. Such probes have typically been bent probes, such as disclosed in U.S. Pat. No. 2,574,433, issued Nov. 6, 1951, and entitled "System For Directional Interchange of Energy Between Waveguides and Free Space", or a loop generally as disclosed in U.S. Pat. No. 3,176,300, issued Mar. 30, 1965, and entitled "Adjustable Slotted Waveguide Radiator With Coupling Element".

The loop or bent probe types of implementation are far too critical in terms of physical tolerances for stable electrical parameters. However, with waveguide sizes of larger dimension such as WR-975 (i.e. 5.125 inches by 10.0 inches), the use of the bent probe or loop excited narrow wall edge slots become feasible. Investigation of the bent probe reveals that it has very limited capability in the amount of coupled excitation it can provide to a true narrow wall transverse edge slot. The usefulness of the slot excited in this mannner is thus limited. Greater coupling can be achieved by using the loop arrangement, but this geometry has the disadvantages of unsuitable narrow band impedance characteristics and very poor mechanical integrity.

SUMMARY OF THE INVENTION

The present invention pertains to a probe loop associated with a transverse edge slot radiator wherein a rectangular waveguide having broad walls and narrow walls defines a transverse edge slot extending generally perpendicular to the longitudinal axis of the waveguide in a narrow wall and has a probe associated therewith including a first elongated conductor portion connected adjacent one end thereof to the narrow wall adjacent said slot and extending perpendicularly inwardly therefrom and a second elongated conductor portion connected adjacent one end thereof to a broad wall and extending perpendicularly inwardly therefrom with the inwardly extending ends of said first and second conductor portions being connected together.

This continuous probe-loop configuration has the advantages of greater coupling range relative to the prior art bent probe or loop type devices, it is mechanically more stable and reproducible, it has the capability of a more practical configuration for smaller waveguide sizes, and the impedance characteristics are more suitable for broad band matching than previous loop geometries.

It is an object of the present invention to provide a new and improved probe loop feed for a transverse edge slot radiator.

It is a further object of the present invention to provide a new and improved probe loop feed for a transverse edge slot radiator with improved coupling and structural integrity.

These and other objects of this invention will become apparent to those skilled in the art upon consideration of the accompanying specification, claims and drawings.

BRIEF DESCRIPTION OF THE DRAWINGS

Referring to the drawings,

FIG. 1 is a view in perspective of a transverse edge waveguide slot radiator with a probe-loop feed embodying the present invention, portions thereof broken away and shown in section; and FIG. 2 is a view similar to FIG. 1 illustrating plural probe-loops feeding a transverse edge waveguide slot.

DESCRIPTION OF THE PREFERRED EMBODIMENTS

Referring specifically to FIG. 1, a rectangular waveguide generally designated 10 has a lower broad wall 11 and an upper broad wall 12 joined together by a narrow wall 14. An opposite narrow wall (not shown) is broken away to provide a clear view of the inner surface of the waveguide. A transverse edge slot 15 is defined by the waveguide 10 in the narrow wall 14. As is well known in the art, the slot 15 will be effectively one-half wavelength long and, consequently, in some instances will extend a short distance into the broad walls 11 and 12. It is desirable to keep the slot 15 short because the extension of the slot 15 into the broad walls 11 and 12 of the waveguide 10 will intercept longitudinal oscillatory currents which will disturb the operation of any array of slots. A first elongated conductor portion 20 has one end fixedly connected to the broad wall 11 by any convenient means, such as soldering, brazing, screws, etc. The conductor portion 20 extends into the waveguide 10 generally perpendicular to the broad wall 11 and may be considered an E-plane probe. A second elongated conductor portion 25 has one end 26 connected to the narrow wall 14 adjacent the slot 15 and extends inwardly generally perpendicular to the narrow wall 14. The conductor portion 20 has an inner end 28 and the conductor portion 25 has an inner end 29, which inner ends 28 and 29 are connected together. Thus, the conductor 25 is oriented approximately perpendicular to the E-field and connects to one side of the transverse slot 15. While the inner ends 28 and 29 of the conductor portions 20 and 25 are connected directly together in this embodiment to place the probe loop in a plane generally perpendicular to the longitudinal axis of the waveguide 10, it should be understood that the portions 20 and 25 could be spaced apart along the longitudinal axis and a third conductor portion extending parallel to the longitudinal axis of the waveguide 10 could be used to connect the ends 28 and 29. Since the third portion is parallel to the longitudinal axis of the waveguide it would have little or no effect electrically and improved phase control could be obtained. Also, the term "generally perpendicular" is meant to include a slight diagonal directing of the conductor portion 25 to place the conductor portion 20 in the plane of the slot 15, or otherwise position the conductor portion 20 for better phase control.

By connecting the E-plane probe, conductor portion 20, to the broad wall 11 greater structural integrity, and especially vibration resistance, is developed. Also, this configuration provides greater energy coupling between the slot 15 and the waveguide 10. In addition, the configuration reduces or eliminates the probe to broad wall capacity found in prior art bent probe configurations which produces a much greater power handling capability. While an inherent increase in impedance discontinuity occurs the resulting mismatch can be matched with conventional waveguide techniques.

The $TE_{10}$ E-field distribution is indicated by the line of arrows designated 30. Since the E-field distribution increases toward the center of the broad wall 11, the lateral position of the conductor portion 20 governs the coupling magnitude. The conductor portion 25 will normally engage the narrow wall 14 at approximately its mid-point but the attachment point of the end 26 to the narrow wall 14 controls to a limited extent the slot impedance match relative to the probe.

Referring to FIG. 2, similar parts are designated with similar numbers and all numbers have a prime added to indicate a second embodiment. In this embodiment a second probe formed of two conductor portions 35' and 36' is included. The probe is connected similar to the previously described probe except that the end of the conductor portion 35' is connected to the broad wall 12', and the conductor portion 36' is connected to the opposite edge of the slot 15'. A phase reversal of 180° may be controlled by choosing to which broad wall of the waveguide or to which side of the slot the probe connections are made. The use of dual probe-loops as illustrated in FIG. 2, utilizing the phase reversal information, gives attendant additional impedance and coupling control. Further, arrays of slots can be constructed utilizing dual probe loops of proper phase reversal of loops, similar to the arrays described in the prior art.

Thus, a transverse edge waveguide slot with probe-loop feed has been described in which a greater coupling range can be achieved compared to prior art configurations. Further, the present probe-loop feed is mechanically more stable and reproducible than the cantilevered bent probe or loop configurations and is a more practical configuration for smaller waveguide sizes. Further, the impedance characteristics are often more suitable for broad band matching than previous loop geometries and it has a much greater power handling capability due to elimination of the probe to broad wall capacity found in prior art designs.

While we have shown and described specific embodiments of this invention, further modifications and improvements will occur to those skilled in the art. We desire it to be understood, therefore, that this invention is not limited to the particular forms shown and we intend in the appended claims to cover all modifications which do not depart from the spirit and scope of this invention.

What is claimed is:

1. In a rectangular waveguide having broad walls and narrow walls, feed apparatus for a transverse edge waveguide slot comprising a conductor lying in a plane generally perpendicular to the longitudinal axis of the waveguide with a first portion connected adjacent an end thereof to a narrow wall adjacent the slot and extending generally perpendicularly inwardly therefrom, and a second portion connected adjacent an end thereof to a broad wall and extending generally perpendicularly inwardly therefrom.

2. Feed apparatus as claimed in claim 1 wherein the conductor is generally L shaped with the arms forming the first and second portions.

3. Feed apparatus as claimed in claim 1 wherein the first portion is connected to the narrow wall approximately at the mid-point of the narrow wall.

4. Feed apparatus as claimed in claim 1 wherein two conductors are utilized on opposite sides of the slot with the second portions thereof being connected to opposite broad walls.

5. In a rectangular waveguide having broad walls and narrow walls, a transverse edge slot radiator comprising:

(a) a transverse edge slot defined by the waveguide and extending generally perpendicular to the longitudinal axis of the waveguide in a narrow wall;

(b) a first elongated conductor portion connected adjacent one end thereof to the narrow wall adjacent said slot and extending perpendicularly inwardly therefrom; and (c) a second elongated conductor portion connected adjacent one end thereof to a broad wall and extending perpendicularly inwardly therefrom, the inwardly extended ends of said first and second conductor portions being connected together.

6. A slot radiator as claimed in claim 5 wherein the first and second conductors form a generally L shaped conductor that lies in a plane generally perpendicular to the longitudinal axis of the waveguide.

* * * * *